US010634315B2

(12) United States Patent
Harper

(10) Patent No.: US 10,634,315 B2
(45) Date of Patent: Apr. 28, 2020

(54) LANDSCAPE LIGHTING ASSEMBLY HAVING A CYLINDRICAL GOBO

(71) Applicant: Volt, LLC, Lutz, FL (US)

(72) Inventor: Jesse Daniel Harper, Wesley Chapel, FL (US)

(73) Assignee: Volt, LLC, Tampa, FL (US)

( * ) Notice: Subject to any disclaimer, the term of this patent is extended or adjusted under 35 U.S.C. 154(b) by 0 days.

(21) Appl. No.: 16/021,600

(22) Filed: Jun. 28, 2018

(65) Prior Publication Data

US 2019/0049096 A1 Feb. 14, 2019

Related U.S. Application Data

(60) Provisional application No. 62/543,431, filed on Aug. 10, 2017.

(51) Int. Cl.
*F21W 131/109* (2006.01)
*F21V 11/08* (2006.01)
(Continued)

(52) U.S. Cl.
CPC ..... *F21V 11/08* (2013.01); *F21V 21/108* (2013.01); *F21V 23/001* (2013.01); *F21V 27/02* (2013.01);
(Continued)

(58) Field of Classification Search
CPC ..... F21V 21/0824; F21V 33/00; F21V 11/08; F21V 3/02; F21V 3/049; F21V 21/116; F21V 21/108; F21V 23/001; F21V 27/02; F21V 17/002; F21V 11/06; F21V 23/02; F21V 1/24; F21V 23/06; F21Y 2115/10; F21W 2131/10; F21W 2131/109;
(Continued)

(56) References Cited

U.S. PATENT DOCUMENTS 3,777,138 A * 12/1973 Metzler ..... F21V 21/116 362/235
4,293,899 A * 10/1981 Sanner ..... F21V 29/004 362/294
(Continued)

OTHER PUBLICATIONS

"Volt 26" Scroll Tower Bollard Light 4' Lead Wire Aluminum Black webpage accessed at https://www.voltlighting.com/outdoor-landscape-lighting-12v-bollard-path-area-light-scroll-26-bz/p/vpl-1017-26-4-abz on Apr. 13, 2017, all enclosed pages cited.
(Continued)

*Primary Examiner* — Anh T Mai
*Assistant Examiner* — Fatima N Farokhrooz
(74) *Attorney, Agent, or Firm* — Nelson Mullins Riley & Scarborough, LLP

(57) ABSTRACT

A landscape lighting assembly is provided that comprises a support stanchion having a proximal end and a distal end. The proximal end of the support stanchion is configured to be connected to a surface. A lamp housing is located at the distal end of the support stanchion and an illumination element (e.g., one or more light emitting diodes) is located inside of the lamp housing. A power supply configured to supply power to the illumination element is also provided. The lamp housing includes a cylindrical gobo comprising a decorative pattern configured to cause a shadow of the decorative pattern to be cast on the surface when the illumination element is lighted.

14 Claims, 4 Drawing Sheets

(51) Int. Cl.

| | |
|---|---|
| ***F21V 21/108*** | (2006.01) |
| *F21V 23/00* | (2015.01) |
| *F21Y 115/10* | (2016.01) |
| *F21V 27/02* | (2006.01) |
| *F21W 121/00* | (2006.01) |

(52) U.S. Cl.
CPC ... *F21W 2121/00* (2013.01); *F21W 2131/109* (2013.01); *F21Y 2115/10* (2016.08)

(58) Field of Classification Search
CPC .. F21W 2121/00; E04F 13/0871; F21S 8/081; F21S 8/083; Y10S 362/806
See application file for complete search history.

(56) References Cited

U.S. PATENT DOCUMENTS 5,055,987 A * 10/1991 Ellson ..... F21S 8/081 362/145
5,430,631 A * 7/1995 Dick ..... E04C 3/32 362/216
8,632,234 B1 * 1/2014 Lowe ..... F21S 8/081 362/153.1
2002/0191391 A1 * 12/2002 Van Etten ..... F21S 8/083 362/153
2003/0117806 A1 * 6/2003 De'Armond ..... F21S 8/033 362/432
2006/0102758 A1 * 5/2006 Johnson ..... B05B 12/06 239/590.3
2008/0185988 A1 * 8/2008 Fan ..... F21S 9/035 320/101
2012/0069581 A1 * 3/2012 Chen ..... F21V 3/061 362/311.14
2013/0208454 A1 * 8/2013 Chen ..... F21S 9/035 362/183
2015/0003045 A1 * 1/2015 Ho ..... F21V 9/12 362/101
2017/0059130 A1 * 3/2017 Sittner ..... F21V 11/00

OTHER PUBLICATIONS

"Volt 26" Leaf Tower Bollard Light 4' Lead Wire Aluminum Black webpage accessed at https://www.voltlighting.com/outdoor-landscape-lighting-12v-bollard-path-area-light-leaf-26-bz/p/vpl-1018-26-4-abz on Apr. 13, 2017, all enclosed pages cited.
"Welcome to Attraction Lights!" webpage accessed at http://attractionlights.com/ on Apr. 13, 2017, all enclosed pages cited.
"Volt Lighting Launches Shadowmaster Path & Area Light" Press Release issued Apr. 11, 2017, all enclosed pages cited.
U.S. Appl. No. 16/111,301, filed Aug. 24, 2018, all enclosed pages cited.

* cited by examiner

LANDSCAPE LIGHTING ASSEMBLY HAVING A CYLINDRICAL GOBO

PRIORITY CLAIM

This application is based upon and claims priority to U.S. provisional application Ser. No. 62/543,431, filed Aug. 10, 2017. The aforementioned application is incorporated fully herein by reference in their entirety for all purposes.

FIELD OF THE INVENTION

The present invention relates generally to landscape lighting assemblies. More particularly, the present invention relates to a landscape lighting assembly having a cylindrical gobo.

BACKGROUND

Lighting assemblies typically include an illumination element (i.e., a light of some sort) and a housing to contain the illumination element. In some instances, the housing may include one or more decorative features, such as etched panes, filigree styled arms, or the like. The decorative features may block some light causing the feature to contrast with the portions passing light.

A gobo (sometimes short for "goes before optics" or "graphical optical black out") may be used to cast a shadow. A gobo is a physical stencil (template) that is placed inside or in front of a light source, to control the pattern of the emitted light. They are often used with stage lighting instruments to manipulate the light pattern which is cast over a space or onto an object. A gobo with patterned holes allows only the desired pattern of light through, casting a specific shadow pattern.

Lighting assemblies for casting shadows, both in and out of the theater environment, generally use a flat gobo disposed vertically in front of the light source. The light source and gobo are generally pointed directly at the surface on which the light and/or shadow pattern is desired to be seen. A deviation from the intended angle between the gobo and the surface may cause distortion of the projected pattern.

Landscape lighting assemblies in the form of rectangular bollards are known that are configured to cast a shadow in a surrounding area. These lighting assemblies have support pillars in the corners that support four flat gobos defining each face of the bollard. The flat shape of the gobos and the support pillars cause undesirable breaks and distortions in the shadow pattern projected on the surrounding surface.

SUMMARY OF CERTAIN ASPECTS

The present invention recognizes and addresses the foregoing considerations, and others, of prior art construction and methods. In this regard, certain exemplary and non-limiting aspects of the present invention will now be described. These aspects are intended to provide some context for certain principles associated with the present invention, but are not intended to be defining of the full scope of the present invention.

In an example embodiment, a landscape lighting assembly is provided that comprises a support stanchion having a proximal end and a distal end. The proximal end of the support stanchion is configured to be connected to a surface. A lamp housing is located at the distal end of the support stanchion and an illumination element (e.g., one or more light emitting diodes) is located inside of the lamp housing.

A power supply configured to supply power to the illumination element is also provided. The lamp housing includes a cylindrical gobo comprising a decorative pattern configured to cause a shadow of the decorative pattern to be cast on the surface when the illumination element is lighted.

For example, the decorative pattern may be a repeating pattern that repeats at least four times around a circumference of the cylindrical gobo. Each instance of the repeating pattern may be separated by an axial element in the cylindrical gobo. In some exemplary embodiments, the power supply may comprise electrical wiring and the lamp housing may comprise a cable routing tube attached to and aligned with one of the axial elements, the electrical wiring passing through the cable routing tube. In an example embodiment, the decorative pattern may be formed as swirls.

Preferably, the cylindrical gobo may have a first end distal from the support stanchion and a second end proximal to the support stanchion, the diameter of the first end being larger than the diameter of the second end such that an outer face of the cylindrical gobo is angled toward the surface (i.e., the cylindrical gobo is frustoconical). The first end and the second end of the cylindrical gobo may be respectively delimited by first and second parallel rings.

In some exemplary embodiments, a second gobo may be disposed in a radial direction between the support stanchion and the cylindrical gobo. For example, the second gobo may be configured as a substantially flat circular ring. The second gobo preferably comprises a second decorative pattern configured to cause a second shadow to be cast on the surface when the illumination element is lighted, the first shadow and second shadow being concentric. In some exemplary embodiments, a plurality of decorative arms may be attached to and extend from the support stanchion, the decorative arms being configured and positioned to cast no shadow on the surface when the illumination element is lighted.

In some exemplary embodiments, the illumination element is situated along an axis of the support stanchion but is spaced apart therefrom. The lamp housing may include a top housing portion adjacent to the cylindrical gobo opposite the support stanchion so as to cover a first end of the cylindrical gobo. For example, the illumination element may be connected to the top housing portion on an underside thereof.

In some exemplary embodiments, the power supply comprises electrical wiring and the lamp housing comprises a cable routing tube attached to and aligned with a portion of the decorative pattern of the cylindrical gobo, the electrical wiring passing through the cable routing tube.

Additional embodiments of the present invention utilize various combinations of the disclosed elements as supported by the overall disclosure herein. Thus, combinations of elements other than those discussed above may be claimed. Moreover, the accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
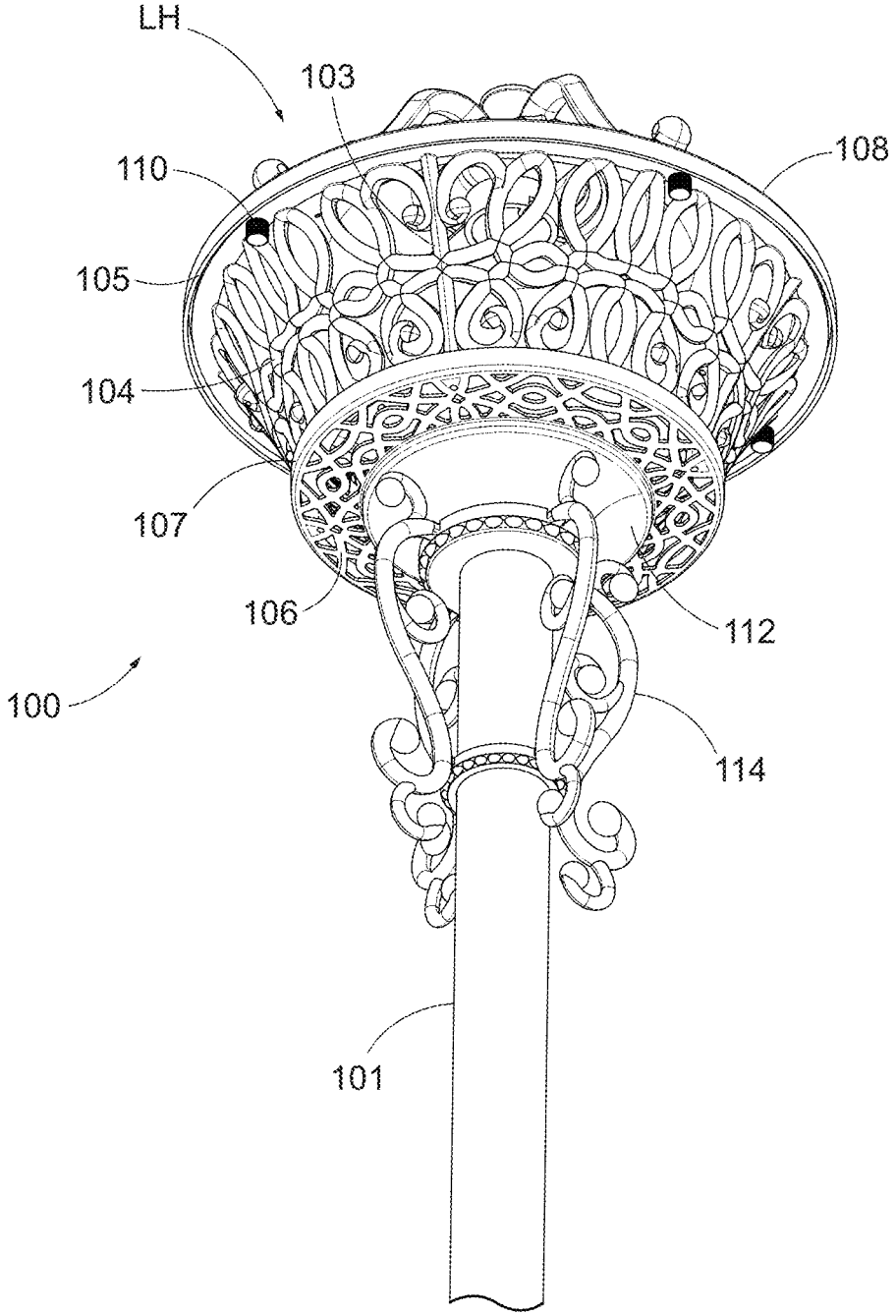
FIG. 1 is a perspective view of a lighting assembly according to an example embodiment.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

In an example embodiment, a lighting assembly is provided including a substantially cylindrical gobo with a continuous decorative pattern. The decorative pattern may cast a shadow onto a surface which is generally free from distortion and the discontinuities of the prior art. In some embodiments, for example, the cylindrical gobo has a frustoconical shape of increasing diameter away from the surface. As a result, the gobo will be angled toward the surface to limit distortion of the pattern. Additionally, various functional and decorative elements of the lighting assembly, such as wiring, decorative arms, and the like, may be disposed in a manner to limit or prevent interference with the shadow pattern cast by the illumination element.

In some example embodiments, the lighting assembly may include a second gobo configured to cast a second shadow onto the surface. The second gobo may be configured to cast a shadow within the first pattern, thus increasing the coverage of the decorative shadows cast about the lighting assembly.

FIG. 1 illustrates a perspective view of a lighting assembly 100 according to an example embodiment. The lighting assembly 100 may include an illumination element 102 (FIG. 2), such as one or more light emitting diodes (LEDs), incandescent lights, compact fluorescent lamps (CFLs), or the like. The illumination element 102 may be powered from a suitable power supply, such as electrical wiring connected with power remote from the lighting assembly, batteries, solar cells, or the like.

Figure 2:
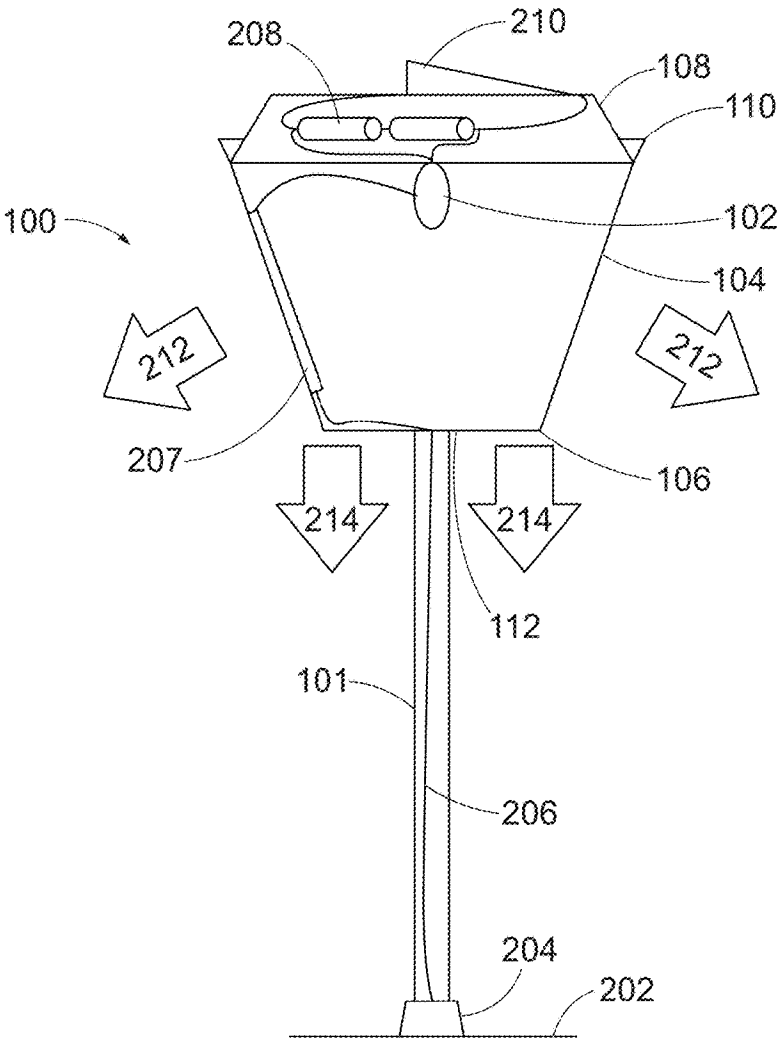
FIG. 2 is a diagrammatic representation showing additional details of a lighting assembly according to an example embodiment.

Referring now also to FIG. 2, the illumination element 102 is disposed within a lamp housing LH mounted to the top (distal) end of a support stanchion 101. A gobo 104, which forms part of lamp housing LH, is configured to cast a shadow pattern on surrounding surface(s). In particular, the gobo 104 comprises a patterned template (e.g., a filigree template) positioned between the illumination element 102 and a surface 202 (depicted in FIG. 2) to cast a particular light and shadow pattern. In an example embodiment, the gobo 104 may be substantially cylindrical and the pattern may be a continuous (e.g., repeating) pattern. The gobo 104 may thus have a distal end and proximal end, in this case defined by a first ring 105 and a second ring 107. The illumination element 102, when powered, casts a shadow pattern on the surface 202 which reflects the decorative pattern of gobo 104.

In some example embodiments, the gobo 104 may be generally frustoconical, such that an outer face of the gobo 104 is angled relative to the surface 202 to cast the shadow in a downward direction onto the surface 202 around lighting assembly 100. In this embodiment, the first ring 105 has a larger diameter than the second ring 107, causing the outer face of the gobo 104 to be angled as described. The angle of the outer face of the gobo 104 limits distortion of the pattern cast by the gobo 104 onto the surface 202 in comparison with a vertical gobo.

Lamp housing LH includes a top housing portion 108 connected to gobo 104 at ring 105 to cover the upper end of the gobo 104. The top housing portion 108 may be permanently or removably coupled to the gobo 104. In a preferred embodiment, for example, one or more fastening elements 110, such as screws, slide locks, tabs, or the like, may be used to removably attach the top housing portion 108. The illumination element 102 may be connected to and supported by the underside of the top housing portion 108 in any suitable manner. For example, a pair of spaced apart bosses may depend from the underside of the top housing portion 108. In this case, the illumination element 102 may be attached directly to the bosses, or may be attached to a support bar or other interposing structure that is attached to the bosses. In any event, the illumination element 102 is preferably disposed substantially centrally relative to the gobo 104 and will emit light radially through the gobo 104. The central deposition of the illumination element 102 will thus cause a substantially symmetrical shadow to be cast by the decorative pattern of the gobo 104 onto surface 202.

In an example embodiment, the lamp housing LH of the lighting assembly 100 may further include a base portion 112 coupled to stanchion 101. As shown, the base portion 112 may be disposed below the second end of the gobo 104. Base portion 112 may be attached to stanchion 101 in any suitable manner, such as screws, bolts adhesive, complementary threads, or the like. In this embodiment, the stanchion 101 is vertical and may support lamp housing LH a predetermined distance, such as 2 ft, 4 ft, 6 ft, or the like, from the surface 202 (e.g., the ground).

In some embodiments, the lighting assembly 100 may include a second gobo 106. The second gobo 106 may be disposed around the stanchion 101, between ring 107 and the base portion 112. In an example embodiment, the second gobo 106 may have a circular configuration and be concentric with the gobo 104 in the radial direction while being spaced apart therefrom in the axial direction. The second gobo 106 may also be frustoconical in shape, but at a small angle relative to surface 202 in comparison with gobo 104. In fact, the angle may be so small in some embodiments that the second gobo 106 may be considered to be a generally flat circular ring. The second gobo 106 casts a second shadow onto the surface 202 when the illumination element 102 is lighted. In this embodiment, the second gobo 106 may cast a shadow on the surface 202 that appears within the shadow cast by the gobo 104. For example, the second gobo 106 may define a second continuous pattern which is complementary to the continuous pattern of the gobo 104, such that the pattern of the gobo 104 is extended by the second gobo 106.

Figure 3:
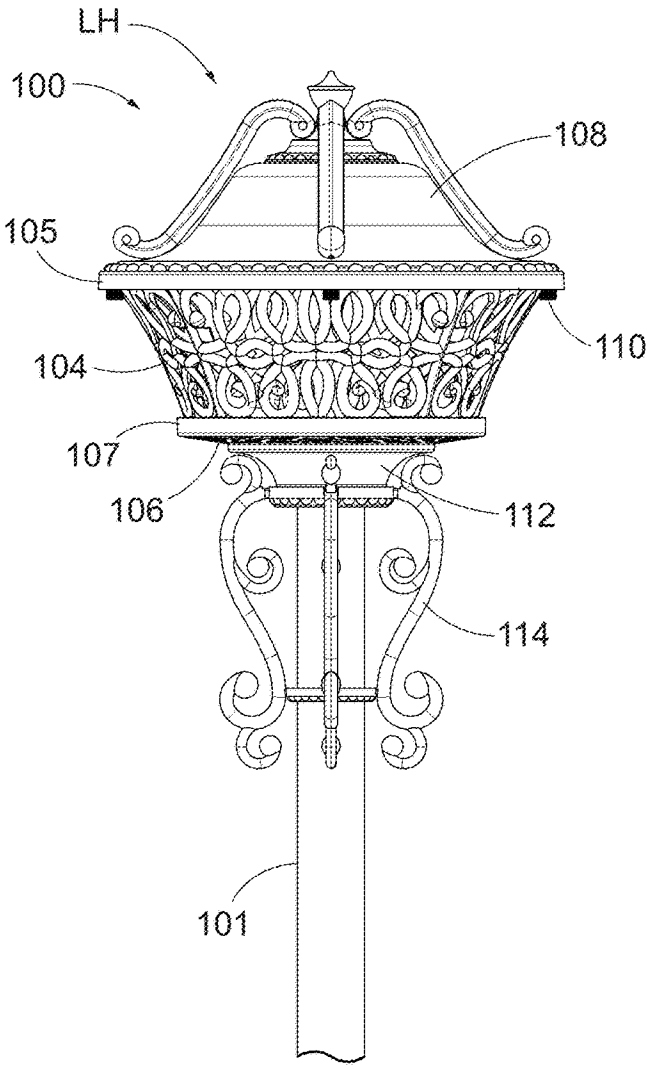
FIG. 3 illustrates a side view of the lighting assembly of FIG. 1.

The illumination element 102 may be axially aligned and vertically displaced from the stanchion 101, enabling a substantially symmetrical shadow to be cast. In some embodiments, gobo 106 may include one or more axial elements 103 extending between rings 105 and 107. Preferably, the axial elements 103 may follow the frustoconical contour of the gobo 104 (thus diverging from the stanchion's axis), such that the axial elements 103 appear as part of the pattern formed by gobo 106. In an example embodiment, the axial elements 103 mark locations where the pattern of gobo 104 repeats. In the embodiment of FIG. 1, for example, lamp housing LH has four equally spaced axial elements 103 such that the pattern of gobo 104 has four iterations of decorative filigree. Each iteration in this embodiment has a series of upper and lower decorative swirls that converge, cross, and diverge (see, e.g., FIG. 3). Preferably, the open areas in the decorative pattern are fully open (i.e., they are not filled with glass or other transparent material).

In some example embodiments, the lighting assembly 100 and/or stanchion 101 may include one or more decorative arms 114. The arms 114 may extend between an outer surface of the stanchion 101 and the base portion 112 of the lighting assembly 100. The arms 114 may be disposed such that they do not cast a shadow when the illumination element 102 is lighted because they are behind base portion 112 in the direction of light emission.

Referring to FIG. 2, the proximal end of the stanchion 101 may be coupled to a surface 202 directly or via a mount 204 (e.g., a stake). In some embodiments, the stanchion 101 may be affixed to the surface, such as by molding, casting, setting into a retention material (e.g., concrete), or the like. It will be apparent to one skilled in the art that the lighting assembly may be attached to any suitable surface, e.g., the ground, a floor, a wall, ceiling, angled structure or the like.

Figure 6:
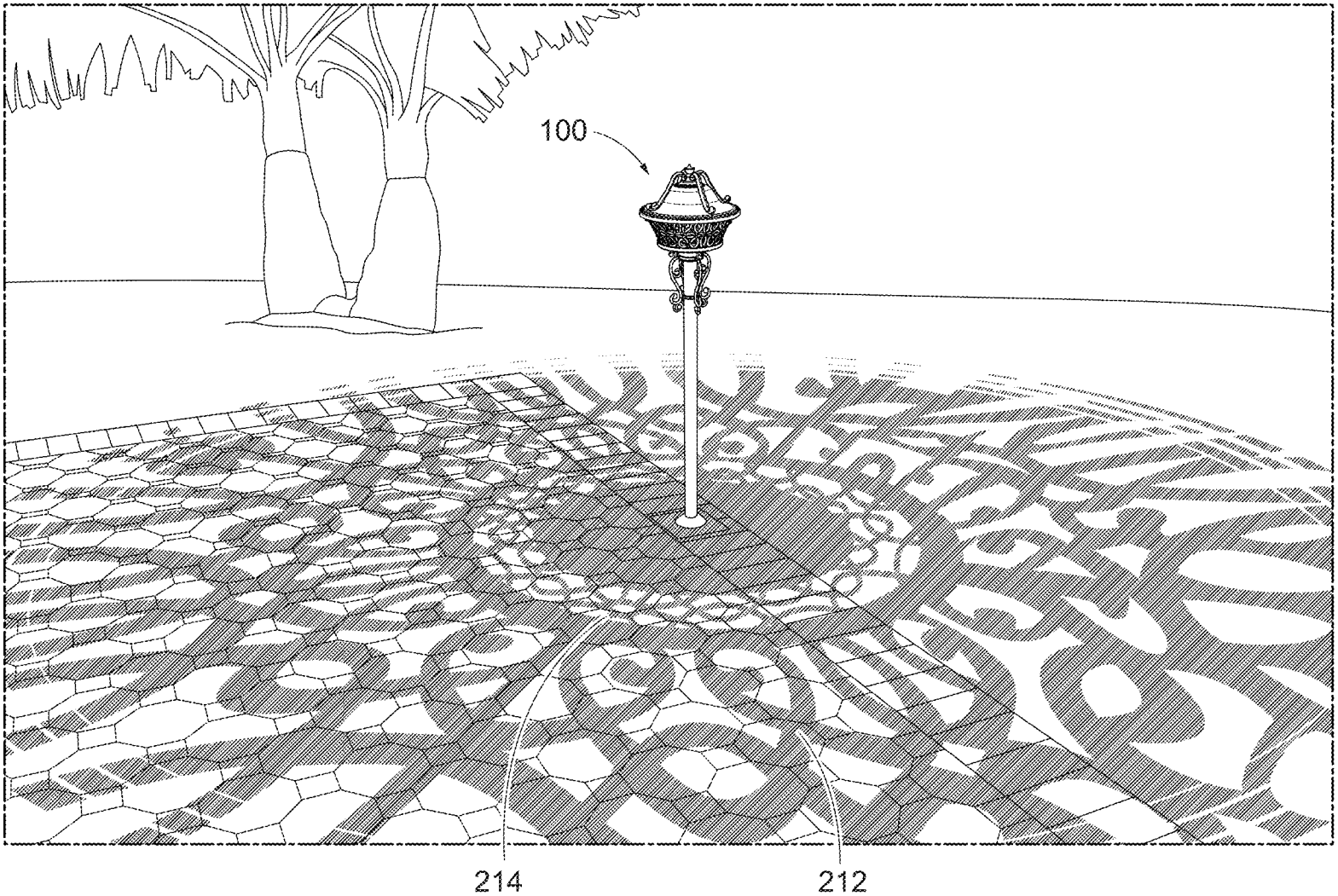
FIG. 6 illustrates shadow patterns cast by the lighting assembly of FIG. 1.

Referring to FIGS. 2 and 6, the lighting assembly 100 casts a first shadow (i.e., a shadow pattern) 212 by the gobo 104 and a second shadow 214 by the second gobo 106. The first shadow 212 may be cast outward and downward toward the surface, due to the angle of the gobo 104. The second gobo 106 may be cast substantially downward toward the surface 202, due to the second gobo 106 being substantially parallel to the surface 202. As clearly shown in FIG. 6, the first shadow 212 and second shadow 214 of the depicted example are concentric about the lighting assembly 100.

Referring again to FIG. 2, lighting assembly 100 further includes a suitable power supply. In an example embodiment, the power supply may comprise wiring 206 that is attachable to a power source remote from the lighting assembly 100, such as a transformer connected to mains power of a building. (In this event, the term "power supply" as used herein includes wiring at lighting assembly 100 but is not deemed to encompass the remote power source.) The stanchion 101 may be in the form of a hollow post that allows the wiring 206 to pass therethrough in a hidden manner. In other embodiments, the power supply may include one or more batteries 208. The batteries may be configured for a single charge or may be rechargeable, such as by a solar cell 210 coupled to the lighting assembly 100, stanchion 101, or the like.

The power supply, e.g., wiring 206, batteries 208, and/or solar cell 210, includes appropriate electrical connections to the illumination element 102. The electrical connections may be configured such that they do not cast a shadow when the illumination element 102 is lighted. In an instance in which the illumination element 102 is supported by top housing portion 108, the lighting assembly 100 may include a cable routing tube 207. In some exemplary embodiments, the cable routing tube 207 may be disposed behind one of the axial elements 103 of the gobo 106. As a result, the cable routing tube 103 will be obscured so that it does not cause a shadow to be cast when the illumination element 102 is lighted. In other embodiments, the cable routing tube 207 may be obscured by other portions of gobo 106. Depending on the obscuring structure, tube 207 may be straight, curved, etc. to conform to the gobo pattern.

Figure 4:
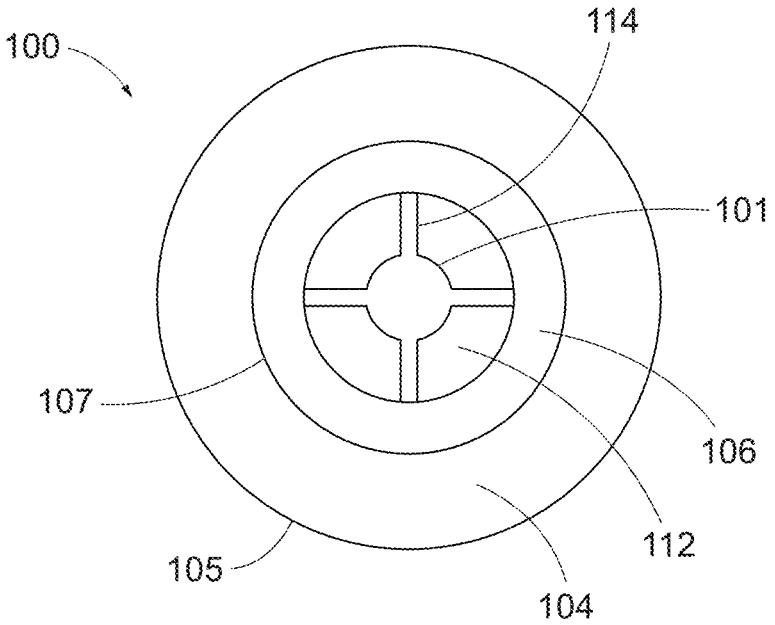
FIG. 4 is a diagrammatic representation of a bottom view of a lighting assembly according to an example embodiment.
Figure 5:
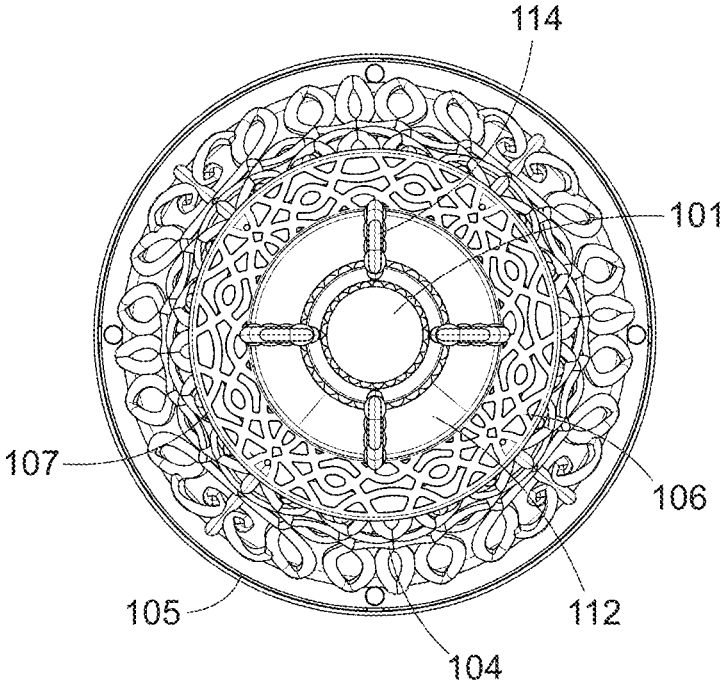
FIG. 5 illustrates a bottom view of the lighting assembly of FIG. 1.

Referring now to FIGS. 4 and 5, stanchion 101, base portion 112, second gobo 106, and the gobo 104 in this embodiment form concentric circles in the radial direction relative to the axis of stanchion 101. As shown, decorative arms 114 may extend from the stanchion 101, but do not extend into the radial area of second gobo 106 (i.e., they remain within the diameter of base portion 112). The base portion 112 may be centered in the second gobo 106, and the second gobo 106 may be radially inside of the gobo 104. The first ring 105 of the gobo 104 is larger than the second ring 107 of the gobo 104, causing the outer face of the gobo 104 to be angled downward toward the surface 202 as described above.

Many modifications and other embodiments of the invention set forth herein will come to mind to one skilled in the art to which the invention pertains having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A landscape lighting assembly comprising:

a support stanchion in the form of a post having a proximal end and a distal end, said proximal end configured to be connected to a surface;

a lamp housing located at the distal end of the support stanchion;

an illumination element located inside of the lamp housing;

a power supply configured to supply power to the illumination element;

said lamp housing including a cylindrical gobo comprising a decorative pattern configured to cause a shadow of the decorative pattern to be cast on the surface when the illumination element is lighted, wherein the cylindrical gobo has a first end distal from the support stanchion and a second end proximal to the support stanchion, the diameter of the first end being larger than the diameter of the second end such that an outer face of the cylindrical gobo is angled toward the surface so as to lessen distortion of the decorative pattern as cast; and a second gobo disposed in a radial direction between the support stanchion and the cylindrical gobo, wherein the second gobo is configured as a substantially flat circular ring and forms a second decorative pattern configured to cause a second shadow to be cast on the surface when the illumination element is lighted, the first shadow and second shadow being concentric.

2. The landscape lighting assembly of claim 1, wherein the decorative pattern is a repeating pattern.

3. The landscape lighting assembly of claim 1, wherein the first end and the second end of the cylindrical gobo are respectively delimited by first and second parallel rings.

4. The landscape lighting assembly of claim 1, comprising a plurality of decorative arms attached to the support stanchion and extending therefrom, the decorative arms being configured and positioned to cast no shadow on the surface when the illumination element is lighted.

5. The landscape lighting assembly of claim 1, wherein the illumination element is situated along an axis of the support stanchion but is spaced apart therefrom.

6. The landscape lighting assembly of claim 1, wherein the illumination element comprises at least one light emitting diode (LED).

7. The landscape lighting assembly of claim 1, wherein areas between the decorative pattern of the cylindrical gobo are open without panes.

8. The landscape lighting assembly of claim 1, wherein the power supply comprises electrical wiring and the lamp housing comprises a cable routing tube attached to and aligned with a portion of the decorative pattern of the cylindrical gobo, the electrical wiring passing through the cable routing tube.

9. The landscape lighting assembly of claim 2, wherein the repeating pattern repeats at least four times around a circumference of the cylindrical gobo.

10. The landscape lighting assembly of claim 9, wherein each instance of the repeating pattern is separated by an axial element in the cylindrical gobo.

11. The landscape lighting assembly of claim 10, wherein the repeating pattern comprises a repeating pattern of swirls.

12. The landscape lighting assembly of claim 10, wherein the power supply comprises electrical wiring and the lamp housing comprises a cable routing tube attached to and aligned with one of the axial elements, the electrical wiring passing through the cable routing tube.

13. The landscape lighting assembly of claim 5, further comprising a top housing portion adjacent to the cylindrical gobo opposite the support stanchion so as to cover a first end of the cylindrical gobo.

14. The landscape lighting assembly of claim 13, wherein the illumination element is connected to the top housing portion on an underside thereof.

* * * * *